United States Patent [19]

Katona

[11] Patent Number: 4,638,529

[45] Date of Patent: Jan. 27, 1987

[54] HANDLE CONSTRUCTION

[75] Inventor: Joseph W. Katona, Walled Lake, Mich.

[73] Assignee: Mills Products, Inc., Farmington, Mich.

[21] Appl. No.: 751,878

[22] Filed: Jul. 5, 1985

[51] Int. Cl.[4] ..... E05B 1/00

[52] U.S. Cl. ..... 16/111 R; 16/114 R; 16/DIG. 5; 16/DIG. 24; 16/DIG. 41; 126/190

[58] Field of Search ..... 16/111 R, 124, 110 R, 16/DIG. 5, DIG. 41; 126/190, 198, 192; 312/320; 49/460; 211/100, 105.1; 248/251, 188.9; 403/345; D8/300, 307, 310

[56] References Cited

U.S. PATENT DOCUMENTS

| | | | |
|---|---|---|---|
| 2,640,671 | 6/1953 | Grady | 211/105.1 |
| 2,731,662 | 1/1956 | Mills | 16/111 |
| 2,849,891 | 9/1958 | Mills | 74/504 |
| 3,017,657 | 1/1962 | Mills | 16/114 |
| 3,137,890 | 4/1964 | Mills | 126/200 |
| 3,149,811 | 9/1964 | Fremstad et al. | 248/251 |
| 4,383,519 | 5/1983 | Katona | 126/190 |

*Primary Examiner*—Donald R. Schran
*Assistant Examiner*—James L. Wolfe
*Attorney, Agent, or Firm*—Barnes, Kisselle, Raisch, Choate, Whittemore & Hulbert

[57] ABSTRACT

A handle assembly for an oven door or the like. The handle assembly comprises a handle grip section and an end cap at each end. The handle grip section is a longitudinally split tubular member. The end caps are capable of mounting the handle grip section in either of two rotative positions 90° apart.

7 Claims, 9 Drawing Figures

HANDLE CONSTRUCTION

This invention relates generally to handle assemblies, and refers more particularly to a handle assembly for an oven door or the like.

BACKGROUND AND SUMMARY OF THE INVENTION

Handle assemblies of the type involved herein comprise elongated, tubular handle grip sections held at the ends by end caps. Roll-formed, tubular handle grip sections are used almost exclusively, being made from flat metal strip by folding to bring the side edges toward one another into substantial abutment and forming inturned flanges along the abutting edges. For reasons of cost, the thickness of the roll-formed handle grip sections is kept to a minimum.

Minimum thickness handle grip sections perform well enough for the shorter (less than 24" long) handles. However, they may not be strong enough to resist deflection when longer handles are utilized, particularly if the deflecting force on the handle grip section is in a direction transverse to the flanges, because I have discovered that the handle grip section is less resistant to deflection in that direction than in a direction parallel to the flanges.

Thus a thinner wall handle grip section, particularly in the longer handles, can be utilized if the end caps are designed to hold the tubular handle grip section so that it is oriented with its flanges parallel to the deflecting force. The problem is that while in some applications the deflecting force is in one direction, in others it is in a different direction.

Accordingly, it is a primary object of this invention to provide a handle assembly in which the end caps are capable of mounting the handle grip section in either of two different rotative positions.

These and other objects will become more apparent as the following description proceeds, especially when considered with the accompanying drawings.

DETAILED DESCRIPTION

Figure 1:
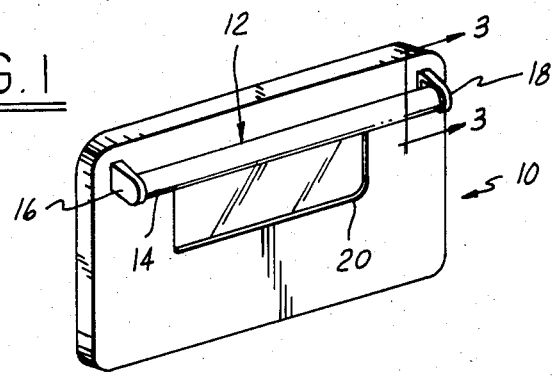
FIG. 1 is a perspective view of an oven door having a handle assembly constructed in accordance with my invention.
Figure 2:
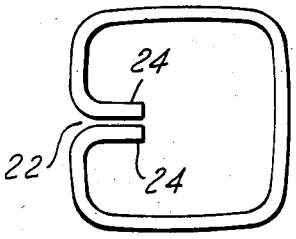
FIG. 2 is an end view of the handle grip section of the handle assembly, shown in an unstressed condition separated from the end caps.
Figure 3:
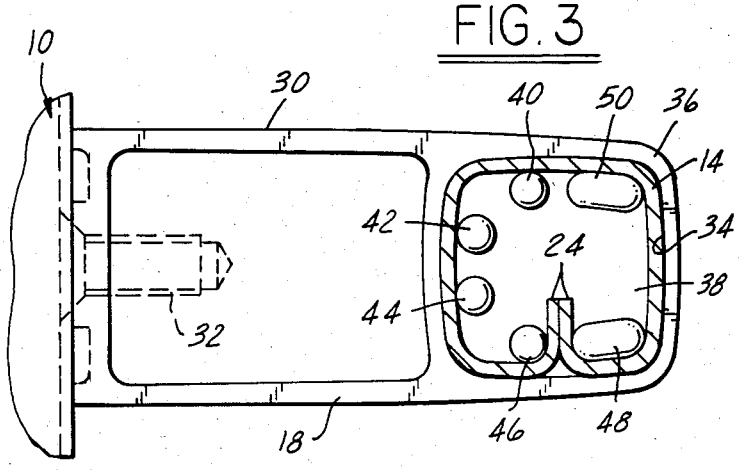
FIG. 3 is a sectional view taken on the line 3—3 in FIG. 1.

Referring now more particularly to the drawings and especially to FIGS. 1–3, thereof, there is shown an oven door 10 having a handle assembly 12 composed of a tubular handle grip section 14 and end caps 16 and 18. The oven door is of the type designed for use with a domestic oven, being hinged at the bottom and having a window 20 for viewing the interior of the oven chamber.

The handle grip section 14 is a relatively thin wall roll-formed member which is made from a flat resilient metal strip by folding the side edges toward one another into substantial abutment so that the handle grip section is an openended, substantially closed tube except for the longitudinal slot or split 22 which extends along its full length. The edges of the roll-formed metal stock are turned inwardly at the split to form parallel flanges 24. The ends of the handle grip section are at right angles to its longitudinal center line as indicated at 26 in Fib. 6. FIG. 2 shows the handle grip section 14 in its natural, unstressed, free-state condition separated from the end caps. In this condition, the tubular handle grip section is of symmetrical, substantially square cross section with rounded corners, and the flanges 24 are slightly spaced apart from one another.

The end caps 16 and 18 are identical. Each end cap has an elongated flat body 30. A screw fastener 32 threads into one end of the body 30 to attach it to the wall of the oven door. When the oven door is closed it is vertical and the end caps extend horizontally in a forward direction away from the door in parallel relation to each other. At the outer end, each end cap has a socket 34 to receive an end of the handle grip section. Socket 34 is defined by a wall 36 and a bottom 38. The shape of the wall 36 of the socket is the same as the shape of the handle grip section 14 and is the same size or preferably very slightly smaller that the handle grip section in its free state (FIG. 2) condition. The bottom 38 of each socket is flat. When the end caps are mounted on the oven door as shown the bottoms 38 are parallel to each other and to the ends of the handle grip section.

Spaced pins 40, 42, 44, 46, 48, and 50 project away from the bottom 38 of the socket of each end cap. Some of the pins are shown as cylindrical and some as oblong, but they may have other configurations. The pins are spaced from the annular wall 36 a distance substantially equal to the thickness of the tubular wall of the handle grip section.

The ends of the horizontal handle grip section 14 are received in the sockets 34 with pins 40–50 fitting within the hollow interior of the handle grip section. The ends of the handle grip section have a flush, abutting contact with the bottoms 38 of the sockets.

The handle grip section 14 is oriented so that the flanges 24 extend between the two pins 46 and 48. Pins 46 and 48 are spaced apart a distance equal to the combined thickness of the two flanges 24 (twice the thickness of one flange). The socket wall 36 of each end cap, being slightly smaller than the handle grip section 14 in its free state condition, compresses the handle grip section and the pins 46 and 48 tightly grip the flanges 24.

The pins 42 and 44 as well as the pins 40 and 50 are spaced apart the same distance as pins 46 and 48 for reasons which will become clear later in this description.

When the oven door is closed and therefore vertical, it may be opened by a horizontal outward pull on the handle grip section 14. However, the oven door may be carried by the handle grip section either by the manufacturer before it is mounted on the oven, or by the homeowner who may remove it for cleaning and/or repair. Carrying the door by the handle applies a lifting force on the handle grip section which would be vertical. The force required to open or close the door is normally substantially less than that required to lift the door. Therefore, the handle grip section 14 in FIGS. 1–3 is oriented with its flanges 24 extending vertical because it can take a greater force without deflection if the force is applied in a direction parallel to its flanges instead of transverse thereto.

Figure 4:
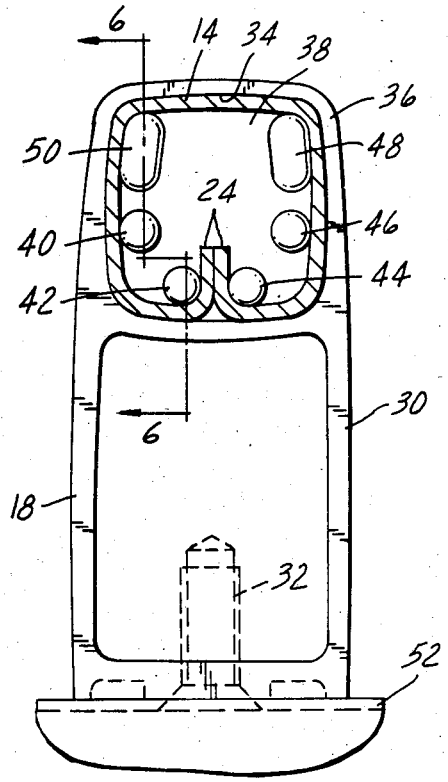
FIG. 4 is a view similar to FIG. 3, but shows the handle assembly on the top of a different appliance, such as a TV set.
Figure 5:
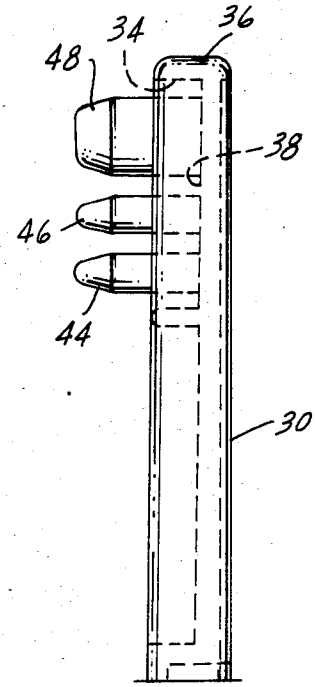
FIG. 5 is an edge view of an end cap.
Figure 6:
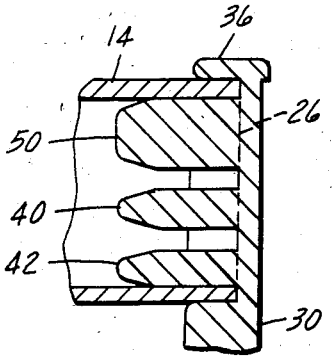
FIG. 6 is a fragmentary sectional view taken on the line 6—6 in FIG. 4

FIG. 4 shows the handle assembly 12 mounted on the top of an appliance 52 such as a TV set. The end caps 16 and 18 extend vertically upward from the top of the appliance, being secured thereto by the screws 32. The horizontal handle grip section 14 extends horizontally between the end caps 16 and 18, and its ends are received in the sockets 34 of the end caps in the same relationship as in the embodiment of FIGS. 1–3 except that the handle grip section is rotated 90° so that its flanges 24 are disposed between pins 42 and 44. Since the handle grip section is symmetrical, its ends are received snuggly in the sockets, and the flanges 24 are tightly gripped between pins 42 and 44. The reason that the handle grip section in FIG. 4 is rotated 90° relative to the end caps from the position shown in FIG. 3 is that the vertical lifting force on the handle in the embodiment of FIG. 4 is in the direction of length of the end caps rather than transversely as in FIG. 3. In this position of rotation of the handle grip section, the flanges 14 extend in the direction of the lifting force for maximum resistance to deflection.

Figure 7:
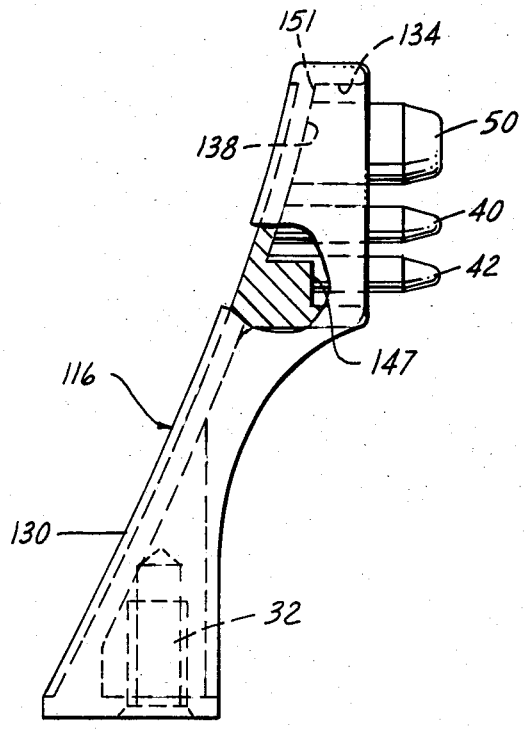
FIG. 7 is an edge view, with parts in section, showing an end cap of modified construction.
Figure 8:
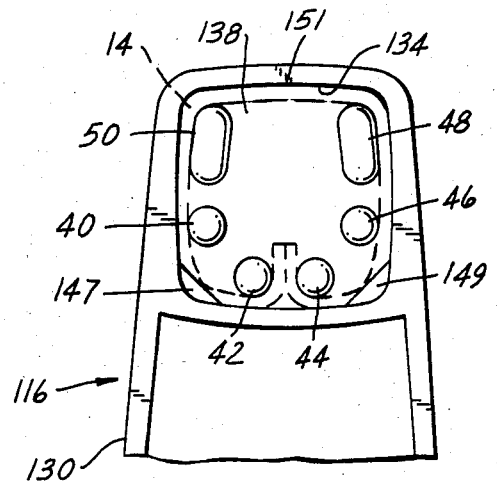
FIG. 8 is a fragmentary inside elevational view of the end cap shown in FIG. 7.

FIGS. 7 and 8 show an end cap 116 of modified construction, two of which can be substituted for end caps 16 and 18 in a handle assembly including handle grip section 14. The socket 134 is the same as socket 34 of end caps 16 and 18 except that the bottom wall 138 is slanted. In order to provide a stable three point support for the square cut end of the handle grip section, corner seats 147 and 149 are provided which extend out from the low edges of the bottom wall to the level of the high point 151 thereof so that each end of the handle grip section will bear on a socket high point 151 and on the two seats. The pins 40–50 of end caps 116 and identical to those previously described and identically arranged. The body 130 of the end cap 116 differs from the body 30 of end caps 16 and 18 in that it is curved rather than straight.

Figure 9:
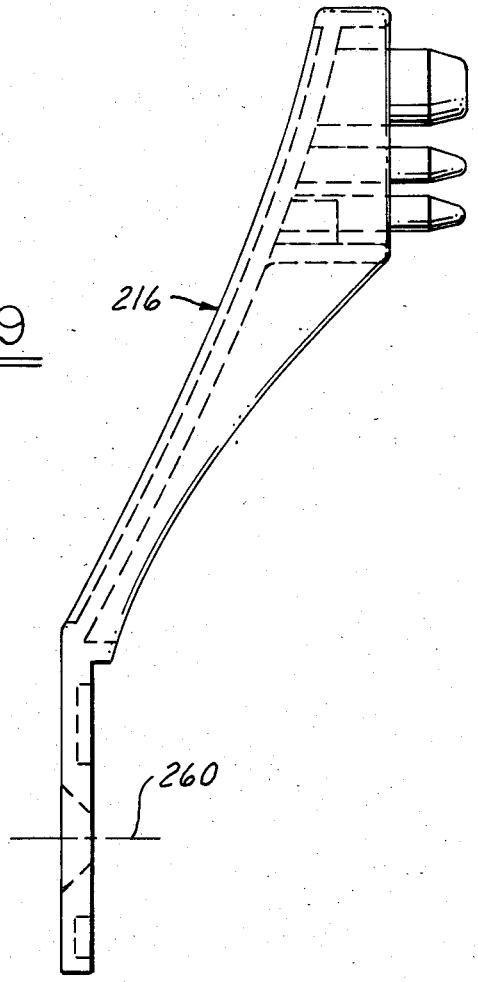
FIG. 9 is an edge view of another end cap of modified construction.

The end cap 216 in FIG. 9 is substantially the same as the end cap 116 except that it is designed for mounting on a side edge of an object rather the surface of the object itself, having an opening 260 for reception of a screw 32 which would extend in the direction of the center line 260.

While the handle grip section 14 has been shown in only two different rotative positions 90° apart, it will be understood that it could be turned another 90° so that its flanges would extend between pins 40 and 50. That could be done in the FIG. 3 embodiment, for example, and still retain maximum resistance to deflection, but then, of course, the split or seam 22 would be exposed to view. Normally only two positions 90° apart are needed, however. The reason for the symmetrical arrangement of pins is so that the end caps 16 and 18 can be made identical, without rights and lefts being required.

As above stated, I have found that even with the basically square handle grip section shown, the strength (or lifting capacity without deflection) is dependent upon orientation. In other words, when a load is applied parallel to the flanges 24, the handle grip section is capable of withstanding a greater force (up to 50% more) without deflection. The end caps have been designed to allow the handle grip section to be assembled so that it may be oriented to take advantage of this greater strength. This has been accomplished without increasing the wall thickness of the tubular handle grip section or otherwise reinforcing it. Although the handle grip section shown is basically square, other symmetrical shapes could be used, such for example, as round or triangular.

What is claimed is:

1. A handle assembly for a unit such as an oven door, comprising an elongated handle grip section and an end cap at each end of said handle grip section, said handle grip section being a longitudinally split tubular member having longitudinal edges defining said split, said longitudinal edges having inturned flanges, said end caps each having means for engaging and mounting an end of said handle grip section alternatively in either of two angularly spaced rotative positions, said engaging and mounting means comprising an outer wall defining a socket receiving said handle grip section, and support means inwardly of said wall fitting within the hollow interior of said handle grip section and relieved at angularly spaced locations to accommodate said flanges in both of said two angularly spaced rotative positions.

2. A handle assembly as defined in claim 1, wherein said support means comprises a plurality of pins projecting inwardly from the bottom of said socket.

3. A handle assembly as defined in claim 2, wherein one pair of said pins are at one such location and another pair of said pins are at the other such location, each pair of pins being adapted to closely receive said flanges of said handle grip section, all of said pins cooperating with said outer wall to closely receive said handle grip section.

4. A handle assembly as defined in claim 1, wherein said two rotative positions are 90° apart and said handle grip section is substantially square in cross section.

5. A handle assembly as defined in claim 4, wherein said support means comprises a plurality of pins projecting inwardly from the bottom of said socket, one pair of said pins being at one such location and another pair of said pins being at the other such location, each pair of pins being adapted to closely receive said flanges of said handle grip section, all of said pins cooperating with said outer wall to closely receive said handle grip section.

6. A handle assembly as defined in claim 5, wherein the ends of said handle grip section are at right angles to the longitudinal center line of said handle grip section and the bottoms of the sockets of said end caps are flat and have a flush engagement with the ends of said handle grip section.

7. A handle assembly as defined in claim 5, wherein the ends of said handle grip section are at right angles to the longitudinal center line of said handle grip section and the bottoms of said sockets have raised seats to engage and provide a stable support for the ends of said handle grip section.

* * * * *